US005460139A

United States Patent [19]

Marlin et al.

[11] Patent Number: 5,460,139

[45] Date of Patent: Oct. 24, 1995

[54] LOWER GUIDE VALVE SEAL

[75] Inventors: Peggy J. Marlin; Daniel A. Crysler, both of Richmond, Ind.

[73] Assignee: Dana Corporation, Toledo, Ohio

[21] Appl. No.: 294,222

[22] Filed: Aug. 22, 1994

[51] Int. Cl.[6] ..... F01L 3/08; F01L 3/02

[52] U.S. Cl. ..... 123/188.3; 123/188.6

[58] Field of Search ..... 123/188.6, 188.9, 123/188.3; 251/330; 277/31, 33

[56] References Cited

U.S. PATENT DOCUMENTS

| | | | |
|---|---|---|---|
| 2,157,867 | 5/1939 | Robertson et al. | 123/188 |
| 2,418,674 | 4/1947 | Steiner | 123/188.6 |
| 2,906,255 | 9/1959 | Bunce | 123/188 |
| 3,162,185 | 12/1964 | Knoblock | 123/188 |
| 3,265,052 | 8/1966 | Goloff | 123/188 |
| 3,577,972 | 5/1971 | Moray | 123/188.6 |
| 4,706,967 | 11/1987 | Ochsner | 123/188.6 |
| 4,834,037 | 5/1989 | Lafever | 123/188 |
| 5,062,397 | 11/1991 | Larson | 123/188 |

FOREIGN PATENT DOCUMENTS

| | | | |
|---|---|---|---|
| 143646 | 9/1980 | Germany | 123/188.9 |
| 49307 | 3/1984 | Japan | 123/188.9 |

*Primary Examiner*—Henry C. Yuen
*Assistant Examiner*—Evick Solis
*Attorney, Agent, or Firm*—Dykema Gossett

[57] ABSTRACT

A valve stem sealing system for an internal combustion engine has a valve guide and an elastomeric valve seal disposed therein. The valve guide is substantially cylindrical in shape and has a longitudinal axis and first and second ends. The valve guide also has a thermal insulating element defining the second end and an internal circumferential groove proximate to the second end. The elastomeric valve seal is disposed in the circumferential groove.

15 Claims, 1 Drawing Sheet

LOWER GUIDE VALVE SEAL

FIELD OF THE INVENTION

BACKGROUND OF THE INVENTION

This invention relates to internal combustion valve seals and more specifically to valve seals located at a lower end portion of a valve guide, proximate to a combustion chamber.

In conventional overhead valve internal combustion engines, at least two valves reciprocate in timed alternation to provide intermittent communication between the intake and exhaust manifolds and a combustion chamber. The valves have valve stems which are commonly disposed in valve guides supporting axial motion in an engine head. Lubrication is provided to upper portions of the valve stems by a spray of lubricating oil within a valve cover disposed over the head, or by gravity flow from an associated rocker arm. Oil flows by gravity along the upper free end of the valve stem toward the valve head. Since temperatures in the combustion chamber may approach or exceed 1000° Celsius, any lubricating oil exposed to these temperatures will vaporize and/or burn, leaving behind deposits which may interfere with proper sealing of the valves.

Seals between the valve stem and the valve guide have been commonly located in an upper end of the valve guide to restrict entry of oil into the combustion chamber. The upper end of the valve guide is distal to the combustion chamber, thereby distancing the seal from the intense heat of combustion.

As the valve axially translates between open and closed positions, the lower end of the stem rubs against a lower end of the guide. With the seal disposed in the upper region within the valve cover, little lubricant reaches a lower end of an overlapping region of the valve stem and valve guide. The seal is configured to supply a controlled flow of lubricant past the seal and along valve stem, providing some minimal protection against wear or scuffing of the valve stem against the guide without producing deposits of oil residue in the seating area. The resultant oil seal is an uneasy compromise which often results in valve scuffing of the valve stem.

A known technique of minimizing or eliminating valve scuffing is to locate the seal in a groove formed in a lower end of the valve stem. The seal seals against an inside diameter of the valve guide. However, because the valve moves within the valve guide, the seal must be located at an axial position along the valve stem which remains within the valve guide for the full range of valve travel so that the seal does not pass out of the valve guide. The resultant distance of the seal from the end of the valve guide may provide some opportunity for valve scuffing to occur. Additionally, the resultant reduction in cross sectional area produced by the valve decreases the strength of the valve stem.

It is also known to provide a seal formed of metal wire windings in a slot in a lower end of the valve guide. A wire seal is generally less effective at sealing than an elastomeric seal. Yet, elastomeric seals are more sensitive to heat when compared with wire seals.

Known engine valve seal arrangements do not readily accommodate the use of an elastomeric seal in an end of the valve guide most proximate to the combustion chamber.

SUMMARY OF THE INVENTION

A disclosed valve stem sealing system for an internal combustion engine includes a valve guide and an elastomeric valve seal disposed therein. The valve guide is substantially cylindrical in shape and has a longitudinal axis and first and second ends. The valve guide also has a thermal insulating portion at the second end and an internal circumferential groove in the second end. The elastomeric valve seal is disposed in the circumferential groove.

Providing the insulating element at a second end of the valve guide slows the transmission of heat from the combustion chamber along the valve guide, allowing an elastomeric seal to be located in the second end portion proximate to the combustion chamber, thereby enabling the controlled use of lubricating oil along nearly the entire length of the valve guide, thereby effectively eliminating valve scuffing.

The advantages of the present invention can be best understood from the following specification and drawings of which the following is a brief description.

DESCRIPTION OF A PREFERRED EMBODIMENT

Figure 1:
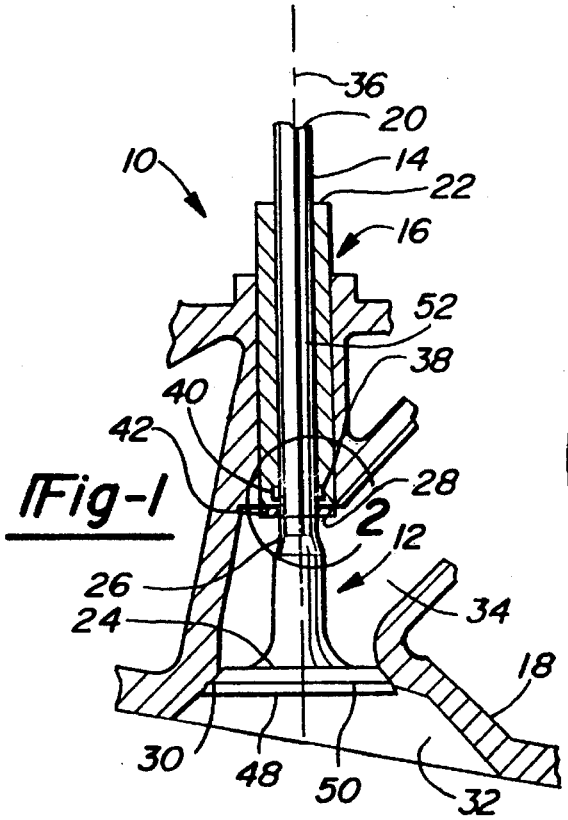
FIG. 1 is a cross-sectional view of a valve and valve guide disposed in an engine head and incorporating the present invention.

A valve stem sealing system 10 as illustrated in FIG. 1 includes a valve 12 with a valve stem 14 slidably disposed in a valve guide 16 fixed in an engine head 18.

The valve 12 is representative of both intake and exhaust valves. A first end 20 of the valve stem 14 extends through and beyond a first end 22 of the valve guide 16 for contact with one of a rocker arm (not shown) or a cam lobe (not shown). The first end 20 of the valve stem 14 has a plentiful supply of engine lubrication oil directed to it to minimize wear between the valve stem 14 and the rocker arm or cam lobe. A valve head 24 is disposed at a second end 26 of the valve stem 14 which extends beyond a second end 28 of the valve guide 16.

The valve 12 is biased to a closed position by a spring (not shown) with the valve head 24 being seated against a valve seat 30 of the engine head 18. When the valve 12 is in the closed position, the valve head 24 blocks flow from a combustion chamber (not shown), defined in part by a combustion chamber side 32 of the engine head 18, to a flow channel 34 in the head 18. When acted on by the rocker arm or the cam lobe, the valve 12 is displaced to an open position, spaced from the seat 30, fluidly connecting the combustion chamber side 32 of the engine head 18 with the flow channel 34.

When the valve 12 is closed, heat from combustion on the combustion chamber side 32 is transferred across the valve head 24 to the valve stem 14. When an exhaust valve 12 moves to the open position following combustion, hot gases at approximately 1000° Celsius pass through the flow channel 34 exposing the second end 28 of the valve guide 16 to extremely high temperatures.

The valve guide 16 is substantially cylindrical in shape and has a longitudinal axis 36. The valve guide 16 is fixed in the engine head 18. Typically, in well known valve stem sealing systems, an annular elastomeric seal (not shown) is disposed between the valve 12 and the guide 16 at the first end 22 of the guide 16 to prevent an excess of lubricating oil from reaching the combustion chamber. Oil reaching the combustion chamber would be vaporized or burned therein because of the high temperatures, leaving behind deposits which may interfere with proper seating of the valve 12, consequently affecting engine performance. However, to minimize scuffing of the valve 12 caused by rubbing of the second end 26 of the valve stem 14 against the second end 28 of the valve guide 28, the seal is configured to meter a small quantity of oil down the valve stem 14. The metering characteristic is difficult to control and can result in either too much oil reaching the second end 28 of the guide 16, and hence producing unwanted deposits, or not enough oil, resulting in stuffed valve stems 14.

The present invention makes the uneasy compromise between too much and not enough oil reaching the second end 28 of the valve stem 14 unnecessary by moving the seal to the second end 28 of the valve guide 16. The oil may reach the second end 28 of the valve guide 16 without restriction, thereby preventing scuffing. An elastomeric seal 38 is disposed in an internal circumferential groove 40 in the valve guide 16 proximate to the second end 28. The seal 38 is captured on three sides by the groove 40 and is trapped on a fourth side by the valve stem 14. The seal 38 is formed of elastomeric material to substantially eliminate any leakage or seapage therepast, preventing the buildup of deposits on the valve seat 30 and head 24.

Silicone, fluorosilicone, fluorocarbon, and highly saturated nitride (HSN) elastomers are all exemplary elastomers from which the seal 38 can be formed. The seal 38 has an exemplary curvilinear X-shaped cross-section providing two circles of contact between the seal 38 and the valve stem 14 to assure effective sealing between the valve 12 and the valve guide 16.

The seal 38 is protected from direct exposure to high temperature exhaust gases and combustion heat by an insulating portion 42 of the valve guide 16 defining the second end 28. A non-insulating portion 44 the guide 16, that is the rest of the guide 16 besides the insulating portion 42, is typically formed of metal such as steel.

It is essential that the seal 38 be protected from heat, as exposure to too high a level of heat would cause the seal 38 to permanently deform, thereby compromising its sealing effectiveness. If the effectiveness of the seal 38 is compromised, oil will seep past the seal 38 to reach the valve head 24. Oil reaching the valve head 24 and exposed to combustion level temperatures would likely vaporize, leaving deposits on the valve head 38 and the seat 40.

Figure 2:
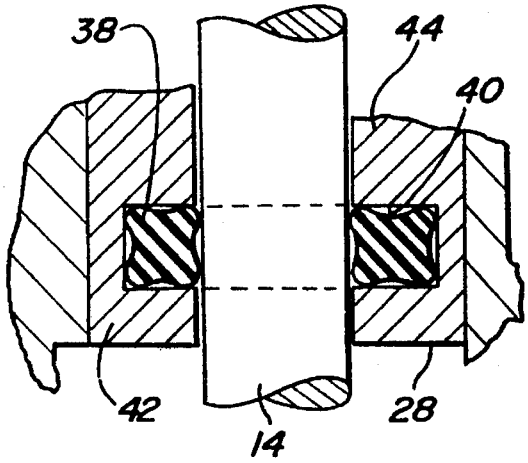
FIG. 2 is an enlarged cross-sectional view of the portion of FIG. 1 found in encircled region circle 2.

Several configurations for the thermal insulating element 42 are shown in the figures. In the exemplary embodiment of FIGS. 1 and 2, the internal circumferential groove 40 for the seal 38 is formed in the non-insulating portion 44. The thermal insulating portion 42 this embodiment is a coating 0.25–0.76 mm (0.010–0.030) inches thick of a zirconium based thermal spray such as $Y_2O_3$–$ZrO_2$, applied to a base coat of a nickel-chromium alloy which acts as a glue for the zirconium based spray.

Figure 3:
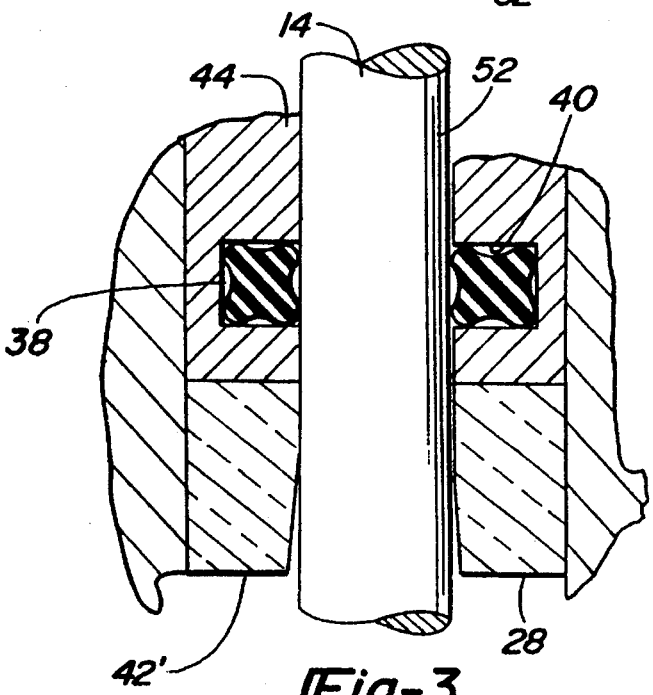
FIG. 3 is an enlarged cross-sectional view of an alternative embodiment of the present invention.

In an alternative embodiment of the valve stem sealing system 10, illustrated in FIG. 3, the thermal insulating portion 44' is an annular piece of ceramic.

Figure 4:
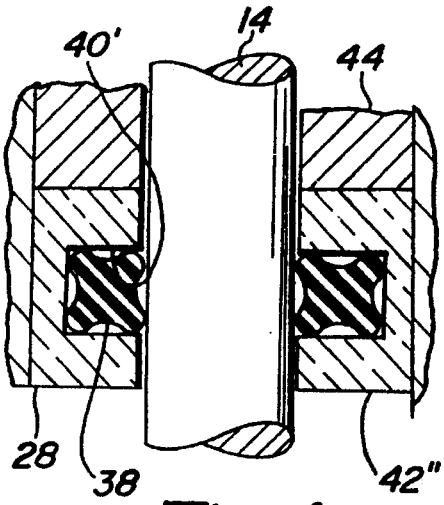
FIG. 4 is an enlarged cross-sectional view of a second alternative embodiment of the present invention.

FIG. 4 illustrates yet another alternative configuration of the valve stem sealing system 10. The internal circumferential groove 40' and the seal 38 therein are located in the thermal insulating portion 42".

Protection of the seal 38 from heat passing through the valve stem 14 is provided by a thermal insulating layer 48 disposed on a combustion chamber side 50 of the valve head 24. The valve head insulating layer 48 slows transmission of combustion heat across the valve head 24 and into the valve stem 14, thus protecting the seal 38.

Additional protection of the seal 38 from heat passing through the valve stem 14 is provided by placing a layer of thermal insulating material 52 over the valve stem 14 in a region expected to be in contact with the valve seal 14. This minimizes the heat transfer through that part of the valve stem 14.

The thermal insulators 42, 48, 52, or barriers, of the present invention make it possible to employ an elastomeric seal 38 at the second end 28 of the valve guide 16 without a significant deterioration in its sealing capabilities by shielding the seal 38 with advantageously located thermal insulators.

Preferred embodiments have been disclosed. A worker of ordinary skill in the art would realize, however, that certain modifications would come within the teaching of this invention. For example, it may be desirable to employ different insulating materials than those disclosed here or different seal elastomers than those specifically disclosed here. Additionally, it may be appropriate in some applications to have the seal 38 slightly removed from the second end portion to provide additional protection from heat. The following claims should be studied in order to determine the true scope and content of the invention.

We claim:

1. A valve stem sealing system comprising:

a substantially cylindrical valve guide having a longitudinal axis and a first end and a second end and defining an internal circumferential groove proximate to the second end and having a thermal insulating portion forming the second end at an end of a non-insulating portion; and an elastomeric valve seal disposed in the circumferential groove.

2. A valve stem sealing system as claimed in claim 1, wherein the circumferential groove is in the non-insulating portion.

3. A valve stem sealing system as claimed in claim 2, wherein the thermal insulating portion is formed by a thermal spray.

4. A valve stem sealing system as claimed in claim 1, wherein the circumferential groove is in the thermal insulating portion.

5. A valve stem sealing system as claimed in claim 4, wherein the thermal insulating portion is an annular piece of ceramic.

6. A valve stem sealing system as claimed in claim 1, additionally comprising a valve with a valve stem having a layer of thermal insulating material covering a portion of the valve stem expected to contact the seal.

7. A valve stem sealing system as claimed in claim 1, additionally comprising a valve having a layer of thermal insulating material disposed on a combustion chamber side of a head of the valve.

8. A valve stem sealing system comprising:

a substantially cylindrical valve guide having a longitudinal axis and a first end and a second end with an internal circumferential groove proximate to the second end;

an elastomeric seal disposed in the circumferential groove;

a valve having a valve stem slidably disposed in the valve guide and having a head at an end of the stem extending beyond the second end of the guide wherein the head is adapted to engage a valve seat; and an insulating element forming part of at least one of the guide and the valve and disposed in a position to reduce heat transfer to the seal from a direction of the head.

9. A valve stem sealing system as claimed in claim 8, wherein the insulating element is disposed on a side of the head opposite the stem.

10. A valve stem sealing system as claimed in claim 8, wherein the insulating element is disposed on a part of the valve stem expected to contact the seal.

11. A valve stem sealing system as claimed in claim 8, wherein the insulating element defines the second end of the valve guide at an end of a non-insulating portion.

12. A valve stem sealing system as claimed in claim 11, wherein the circumferential groove is in the non-insulating portion.

13. A valve stem sealing system as claimed in claim 12, wherein the thermal insulating element is formed by a thermal spray.

14. A valve stem sealing system as claimed in claim 11, wherein the circumferential groove is in the thermal insulating element.

15. A valve stem sealing system as claimed in claim 14, wherein the thermal insulating element is an annular piece of ceramic.

* * * * *